US005967349A

United States Patent [19]

Engelbrecht

[11] Patent Number: 5,967,349

[45] Date of Patent: Oct. 19, 1999

[54] SPRING TAB SHIM SUPPORT IN ROTARY SHANK COUPLER

[75] Inventor: Rodney A. Engelbrecht, Springfield, Ohio

[73] Assignee: Buckeye Steel Castings Company, Columbus, Ohio

[21] Appl. No.: 09/037,261

[22] Filed: Mar. 9, 1998

[51] Int. Cl.[6] ..... B61G 1/10

[52] U.S. Cl. ..... 213/74; 213/62 A; 213/67 A; 213/69; 213/72; 213/74; 105/239; 105/241.2

[58] Field of Search ..... 213/62 A, 67 R, 213/67 A, 69, 70, 71, 72, 74; 105/239, 241.2

[56] References Cited

U.S. PATENT DOCUMENTS

| | | | |
|---|---|---|---|
| 4,128,178 | 12/1978 | DePenti et al. | 213/67 R |
| 4,593,828 | 6/1986 | Hanula et al. | 213/62 R |
| 4,595,109 | 6/1986 | McClurg | 213/62 A |
| 5,507,400 | 4/1996 | Long et al. | 213/62 A |

*Primary Examiner*—Robert J. Oberleitner
*Assistant Examiner*—Robert J. McCarry, Jr.
*Attorney, Agent, or Firm*—Banner & Witcoff, Ltd.

[57] ABSTRACT

A coupler is provided for a railroad rotary dump car. The coupler comprises a coupler housing, a coupler head, a buff loading shim, and as most preferred, a plurality of spring tabs, and spring tab fasteners. The coupler housing defines a coupler cavity with a cavity end. The coupler head has a spindle, is mounted to the coupler housing, and is adapted for rotary movement relative to the housing. The spindle has a spindle end adjacent the cavity end. The shim interposes the spindle end and the cavity end. The spring tabs are spaced one from another. Each includes a spring portion and a fastener portion. The fastener portions provide for removable fastening of the spring tabs to the coupler housing. The spring portions bias the shim against the cavity end and away from the spring tabs. The spring portions are curved relative to the fastener portions. The spring tab fasteners removably fasten the spring tabs along the fastener portions to the coupler housing adjacent the shim. Among other advantages, the shim is positioned and spring biased for abutment by the spindle end and against the cavity end in buff loading and upward and against the cavity end for increased life and reduced wear and damage. Also, the spring tabs may be removed and the shim removed and replaced as necessary due to wear of all components.

8 Claims, 2 Drawing Sheets

SPRING TAB SHIM SUPPORT IN ROTARY SHANK COUPLER

BACKGROUND OF THE INVENTION

This invention relates in general to railroad cars, and in particular, to couplers for rotary dump cars. Rotary dump cars and couplings for such cars are shown in U.S. Pat. No. 4,595,109 issued Jun. 17, 1986 to Carl McClurg and originally assigned to Buckeye International, Inc. of Columbus, Ohio. As exemplied by and shown in this patent, rotary dump cars have long been in use as railroad cars. The cars may be positioned over dump sites and rotated about the longitudinal axes of aligned couplers to dump the car contents into sites adjacent and beneath the cars. Also as shown in this patent, a desirable coupler for application in rotary dump cars includes a coupler head with a spindle in a housing. The spindle has external bearing surfaces arranged for rotary contact with the housing during rotation of the car relative to the adjacent cars. The spindle of the coupler also includes an enlarged flange for bearing of the spindle against the housing for draft loads. In buff loading, the free end of the spindle abuts a shim which abuts the housing, thereby carrying the buff load. The general structure of the identified patent has been highly desirable and continues in substantial commercial production.

Experience has revealed that replacement of the shim over time is desirable as wear occurs in the coupler structure. That is, increased thickness shims are appropriate for installation in worn couplings. As a result, while U.S. Pat. No. 4,595,109 reveals a bottom enclosure casting 40 welded to a housing 16, referring to FIG. 3 of the patent, in the area to the left of the enlarged portion 70 of the spindle 14 and at the bottom of the structure, the welded bottom enclosure casting 40 has in the past been replaced with tabs which are releasably held in place by bolts. Use of the bolted tabs has allowed for replacement of shims over time. However, use of the bolted tabs has also resulted in damage to the bolts and loss of the tabs and shims, which is undesirable. To overcome the damage to the bolts and loss of shims, the size ⅜" bolts initially used have been replaced by ½" grade 8 bolts and then by ½" grade 9 bolts. However, continued damage to the bolts and loss of the tabs and shims has been experienced.

U.S. Pat. No. 4,595,109 is incorporated by reference.

SUMMARY OF THE INVENTION

An object of the present invention is to overcome the damage to the bolted tabs experienced in the past structure which has included bolted tabs.

Another object of the invention is to continue the advantage of the ability to remove and replace shims as necessary to increase the thickness of the shims to accommodate wear.

In a primary aspect then, the invention comprises a coupling substantially as disclosed in U.S. Pat. No. 4,595,109, and which includes the improvement of spring tabs bolted to the underside of the coupling housing to hold the shim in location. The spring tabs as most preferred take the form of spring steel tabs shaped to provide upwardly curved sections which bias the shims upward in the shim space and also toward the innermost face of the shim housing cavity.

In another primary aspect, and more formally, the invention includes a railroad rotary dump car coupler, for a railroad rotary dump car having spaced couplers aligned along an axis, and for providing for rotation of the car relative to the axis of the car couplers. The coupler comprises a coupler housing, a coupler head, a buff loading shim, a plurality of spring tabs, and spring tab fasteners. The coupler housing defines a coupler cavity with a cavity end transverse to the axis. The coupler head has a spindle and is adapted for rotary movement relative to the coupler housing. The spindle has a spindle end transverse to the axis, the spindle end being adjacent the cavity end. The buff loading shim interposes and is between the spindle end and the cavity end, the shim being substantially planar transverse to the axis. The spring tabs are included in a plurality, spaced one from another. Each includes a spring portion and a fastener portion. The fastener portions provide for removable fastening of the spring tabs to the coupler housing. The spring portions bias the shim against the cavity end and away from the spring tabs. As above, the spring portions are curved relative to the fastener portions. The spring tab fasteners removably fasten the spring tabs along the fastener portions to the coupler housing adjacent the shim. With a structure as described, the shim is positioned and spring biased for abutment by the spindle end and against the cavity end in buff loading and upward and against the cavity end for increased life and reduced wear and damage. Also, the spring tabs may be removed and the shim removed and replaced.

The full range of objects, aspects and advantages of the invention are only appreciated by a full reading of this specification and a full understanding of the invention. Therefore, to complete this specification, a detailed description of the invention and the preferred embodiment follows, after a brief description of the drawing.

BRIEF DESCRIPTION OF THE DRAWINGS

The preferred embodiment of the invention will be described in relation to the accompanying drawing. In that drawing, the following figures have the following general nature.

In the accompanying drawing, like reference numbers are used throughout the various figures for identical structures. In the detailed description which follows, terms such as "top" and "bottom" are used in relation to the ordinary orientation of the described and depicted structure when in service. Terms of orientation are not incorporated into the claims except as expressly employed in the claims.

DETAILED DESCRIPTION OF THE PREFERRED EMBODIMENTS

Figure 1:
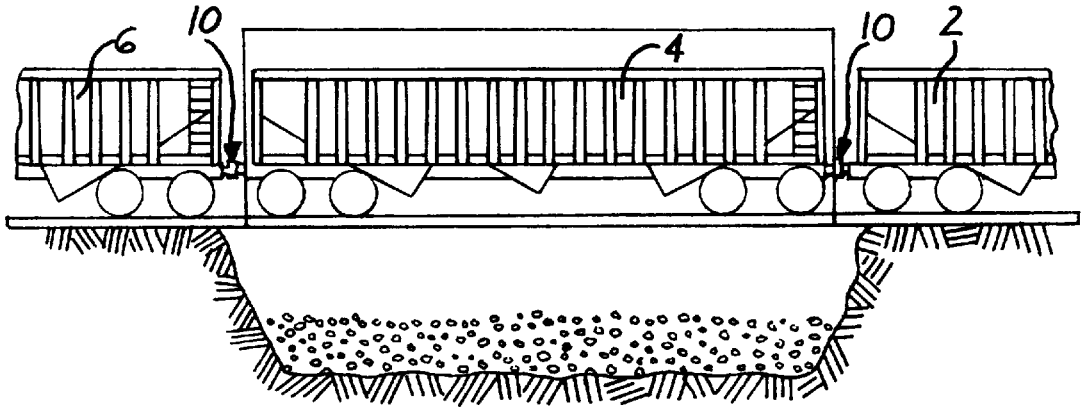
FIG. 1 is a side schematic view of a typical rotary railway dump car positioned over an unloading area, taken from U.S. Pat. No. 4,595,109, employing the improved coupler of that patent and the invention.
Figure 2:
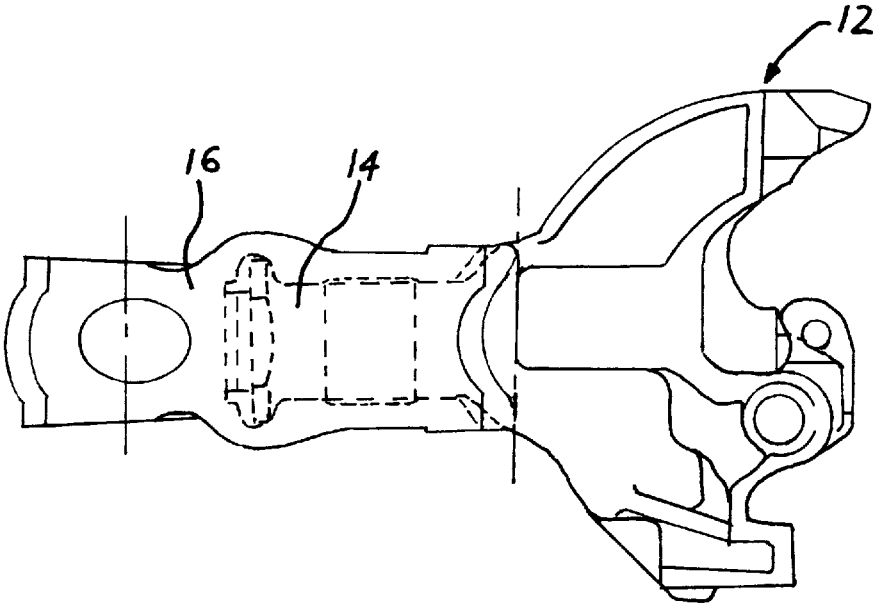
FIG. 2 is a top plan view of the improved coupler of this invention.

Referring to FIG. 1, rotary dump cars 2, 4 and 6 are interconnected by couplers at least one of which includes this invention. The couplers are generally designated 10. In operation of rotary dump cars, a car as desired is positioned over or adjacent a dump site, as dump car 4 is in FIG. 1. A dumper mechanism (not shown) clamps the car to a segment of the rails, and causes the car and rail segment to rotate about the longitudinal axis of the couplers, to dump the car contents into the dump site. The immediate fore and aft cars remain upright during dumping. Thus, at least one of the couplings 10 must be a rotary coupling, and must sustain the compressive and tensile loads normally applied during buff and draft loading of the cars, and must also permit and sustain the loading of rotary movement of a dumping car relative to its fore and aft cars.

Figure 3:
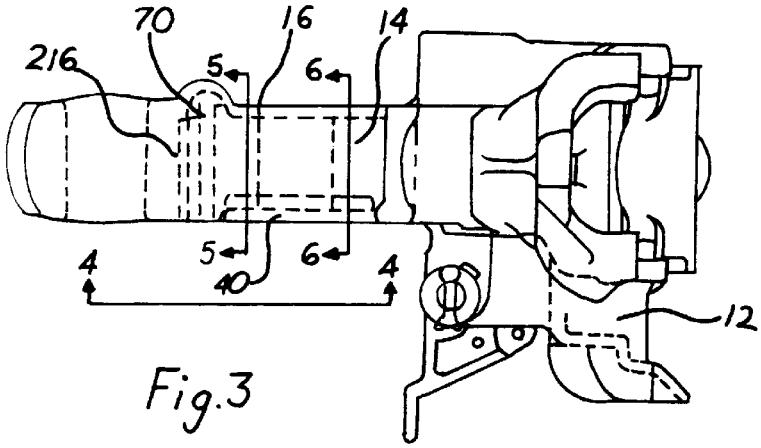
FIG. 3 is a side view.

While U.S. Pat. No. 4,595,109 provides a desirable structure, nevertheless, as above, replacement of the shim of that patented structure with an increased thickness shim (and perhaps replacement of replacement shims with further increased-thickness shims) over time is desirable as wear occurs in the coupler structure. As a result, while U.S. Pat. No. 4,595,109 reveals a bottom enclosure casting 40 welded to the housing 16, referring to FIG. 3 of that patent, in the area to the left of the enlarged portion 70 of the stem 14 and at the bottom of the structure, the welded bottom enclosure casting 40 has been in the past replaced with tabs which are releasably held in place by bolts. Use of the bolted tabs has allowed for replacement of the shims over time. However, use of the bolted tabs has also resulted in damage to the bolts and loss of the tabs and shims. To overcome the damage to the bolts and the losses, the size ⅜" bolts initially used have been replaced by ½" grade 8 bolts and then by ½" grade 9 bolts. However, continued damage to the bolts and losses have been experienced.

Consistent with the above objects, the preferred embodiment of this invention includes an improved railroad rotary dump car coupler 10. As with past couplers, the coupler of the invention comprises a coupler housing 16, a coupler head 12, and a buff loading shim 90, all substantially as shown in the figures of the accompanying drawing, especially FIG. 3, and also as shown and described in the '109 patent.

Figure 4:
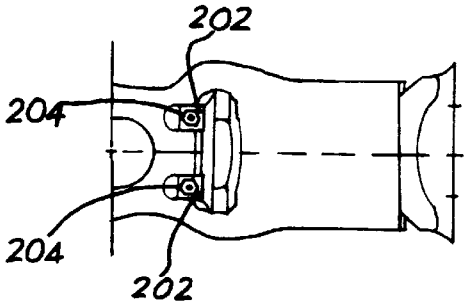
FIG. 4 is a partial bottom view taken along line 4—4.
Figure 5:
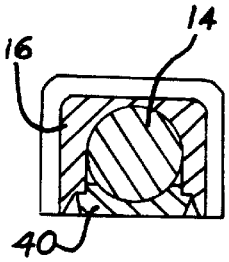
FIG. 5 is a cross-section taken in FIG. 3 along line 5—5.
Figure 6:
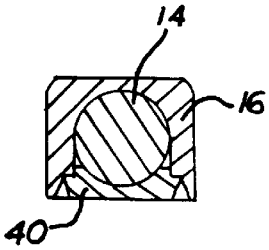
FIG. 6 is a cross-section also taken in FIG. 3 along line 6—6.
Figure 7:
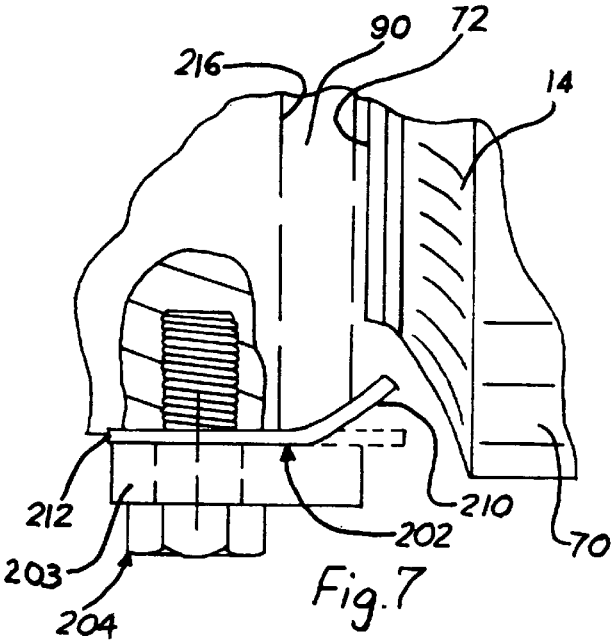
FIG. 7 is a detail view, partially broken away, of the side of one of the spring tabs of the invention in location with a shim and surrounding structure.

Referring to FIGS. 4 and 7, the preferred embodiment newly includes a plurality of spring tabs 202. As with the past plain tabs, the preferred embodiment also includes retainer plates 203 and tab fasteners 204, in the form of bolts. As most preferred, the spring tabs 202, retainer plates 203, and fasteners 204 are present in quantities of two each, spaced transversely from each other across the bottom of the coupler housing. Further, the spring tabs 202 and fasteners 204 are equidistant from each other across the vertical centerline of the coupling.

Figure 8:
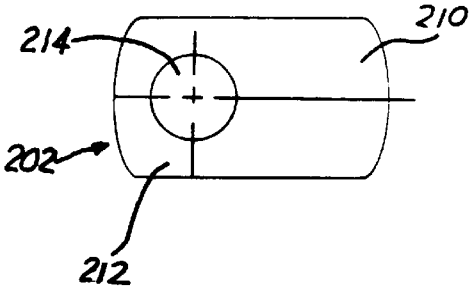
FIG. 8 is a plan view of a spring tab of the invention.

Referring to FIGS. 7 and 8, each spring tab 202 includes a spring portion 210 and a fastener portion 212. The fastener portions 212 include bolt openings 214 which provide for removable fastening of the spring tabs 202 to the coupler housing 16 by the fasteners 204. The spring portions 210 are curved out of the planes of the fastener portions 212. The spring tabs 202 are formed of Type 302 stainless spring steel, 0.015 inches thick. The springs tabs are first shaped, and then the curvature of the spring portions 210 are formed.

The spring tabs 202 bias the shim, referenced as 90, against the cavity end 216 of the coupler housing 16 and away from the retainer plate 203, as shown in FIG. 7. As above, the spring portions 210 are curved relative to the fastener portions 212. The spring tab fasteners 204 removably fasten the spring tabs 202 along the fastener portions 212 to the coupler housing 16 adjacent the shim 90. The shim 90 is positioned and spring biased for abutment by the spindle end 72 of the spindle 14 and against the cavity end 216 in buff loading and upward and against the cavity end 216 for increased life and reduced wear and damage. During loading, the spring portions 210 are flexible relative to the fastener portions 212 for movement between the "home" or rest position shown in solid lines in FIG. 7, and positions ranging to and through the "extended" position shown in dotted line in FIG. 7. When flexed, the spring portions 210 store force and return to the home positions when the loading which has overcome the resilience of the spring portions 210 diminishes.

Thus, the spring portions 210 resiliently load the shim 90 upward and against the cavity end 216 of the coupler housing 16, for movement of the shim 90 as necessary during coupling loading, and for retention of the shim 90 in preferred position in the absence of coupling loading. Spring tabs 202 as described substantially reduce damage to the structure of the coupling, especially damage to the fasteners 204. As a consequence, damage to the coupling structure, including loss of the spring tabs and shims, is substantially eliminated. Also, the spring tabs 202 may be readily removed, and the shim 90 readily removed and replaced whenever wear in the coupling structure makes replacement necessary or desirable.

The coupler may be produced with the invented structure to meet AAR specifications and service requirements. It may be applied to any striker already designed for rotary coupler application, and identical yokes may be used on both ends of cars. The coupler eliminates erratic action of a square shank turning over on a flat carrier. The standard Type "F" coupler shank butt strength is maintained, and shim control of excessive slack is provided.

The preferred embodiments of the invention are now described in such full, clear, concise and exact language as to enable a person of ordinary skill in the art to make and use the same. Variations of the preferred embodiment are possible without being outside the scope of the present invention. Therefore, to particularly point out and distinctly claim the subject matter regarded as the invention, the following claims conclude this specification. Details of the preferred embodiments described above are incorporated into the claims only insofar as consistent with law.

What is claimed is:

1. A railroad rotary dump car coupler, for a railroad rotary dump car having spaced couplers and an axis of rotation, and for providing for rotation of the car relative to the axis, comprising:

a coupler housing defining a coupler cavity with a cavity end;

a coupler head having a spindle and mounted to the coupler housing and adapted for rotary movement relative to the coupler housing, the spindle having a spindle end, the spindle end being adjacent the coupler housing cavity end;

shim means interposed between the spindle end and the cavity end; and spring means, in the form of at least one spring tab, for biasing the shim means, the spring means mounted to the coupler, whereby the shim means is positioned for abutment by the spindle end and against the cavity end in buff loading and against wear and damage.

2. A coupler as in claim 1, the spring means including a plurality of spring tabs mounted to the coupler housing.

3. A coupler as in claim 2, the spring tabs removably fastened to the coupler housing;

whereby the tabs may be removed and the shim means replaced.

4. A coupler as in claim 1, the spring means including a plurality of spaced spring tabs, the spring tabs including spring portions and fastener portions, the fastener portions providing for removable fastening of the spring tabs to the coupler housing and the spring portions biasing the shim means against the cavity end.

5. A coupler as in claim 4, the spring portions also biasing the shim means away from the spring tabs.

6. A railroad rotary dump car coupler, for a railroad rotary dump car having spaced couplers aligned along an axis, and for providing for rotation of the car relative to the axis of the car couplers, comprising:

a coupler housing defining a coupler cavity with a cavity end;

a coupler head having a spindle and mounted to the coupler housing and adapted for rotary movement relative to the coupler housing, the spindle having a spindle end, the spindle end being adjacent the cavity end;

a shim interposed between the spindle end and the cavity end; and a plurality of spaced spring tabs, the spring tabs including spring portions and fastener portions, the fastener portions providing for removable fastening of the spring tabs to the coupler housing and the spring portions biasing the shim against the cavity end and away from the spring tabs, the spring tabs mounted to the housing;

whereby the shim is positioned for abutment by the spindle end and against the cavity end in buff loading and upward and against the cavity end for increased life and reduced wear and damage.

7. A coupler as in claim 6, further comprising means for removably fastening the spring tabs to the coupler housing; whereby the tabs may be removed and the shim removed and replaced.

8. A railroad rotary dump car coupler, for a railroad rotary dump car having spaced couplers aligned along an axis, and for providing for rotation of the car relative to the axis of the car couplers, comprising:

a coupler housing defining a coupler cavity with a cavity end transverse to the axis;

a coupler head having a spindle and mounted to the coupler housing and adapted for rotary movement relative to the coupler housing, the spindle having a spindle end transverse to the axis, the spindle end being adjacent the cavity end;

a buff loading shim interposed between the spindle end and the cavity end, the shim being substantially planar transverse to the axis; and a plurality of spaced spring tabs, the spring tabs each including a spring portion and a fastener portions, the fastener portions providing for removable fastening of the spring tabs to the coupler housing and the spring portions biasing the shim against the cavity end and away from the spring tabs, the spring portions being curved relative to the fastener portions;

spring tab fasteners removably fastening the spring tabs along the fastener portions to the coupler housing adjacent the shim;

whereby the shim is positioned and spring biased for abutment by the spindle end and against the cavity end in buff loading and upward and against the cavity end for increased life and reduced wear and damage; and whereby the spring tabs may be removed and the shim removed and replaced.

* * * * *